United States Patent [19]

Zur

[11] 4,349,924

[45] Sep. 21, 1982

[54] ADJUSTABLE BODY SUPPORTING ASSEMBLIES WITH FORWARD INCLINING HEAD SUPPORT

[75] Inventor: Henry C. Zur, Phoenix, Ariz.

[73] Assignee: Goodman Manufacturing Corporation, Philadelphia, Pa.

[21] Appl. No.: 236,433

[22] Filed: Feb. 23, 1981

Related U.S. Application Data

[63] Continuation-in-part of Ser. No. 41,354, Aug. 1, 1979, Pat. No. 4,258,445.

[51] Int. Cl.[3] ..... A61G 7/00; A61G 7/06

[52] U.S. Cl. ..... 5/68; 5/72; 5/433

[58] Field of Search ..... 5/68, 69, 66, 67, 72, 5/80, 433, 73–79; 297/61

[56] References Cited

U.S. PATENT DOCUMENTS

| | | | |
|---|---|---|---|
| 1,281,074 | 10/1918 | Russell | 5/75 |
| 1,345,760 | 7/1920 | Frye | 5/66 |
| 2,631,300 | 3/1953 | Murray | 5/69 |
| 3,041,121 | 6/1962 | Comper | 5/69 |
| 3,051,965 | 9/1962 | Szemplak et al. | 5/68 |
| 3,191,196 | 6/1965 | Holm | 5/69 |
| 3,281,141 | 10/1966 | Smilley et al.5 | 5/66 |
| 3,781,928 | 1/1974 | Swallert | 5/68 |

*Primary Examiner*—Alexander Grosz
*Attorney, Agent, or Firm*—Paul & Paul

[57] ABSTRACT

An adjustable body supporting assembly comprising a horizontal frame member (4), a back support portion pivotably connected to said frame member, and divided into a lower back support (2) and an upper head support (5) pivotably connected to the lower back support, and a single power means adapted to raise the lower back support and upper head support, from a horizontal position to angular positions in which the lower back support is inclined relative to the frame, and the upper head support is inclined relative to the frame and the lower back support.

3 Claims, 2 Drawing Figures

ADJUSTABLE BODY SUPPORTING ASSEMBLIES WITH FORWARD INCLINING HEAD SUPPORT

This application is a continuation-in-part of Ser. No. 41,354, filed Aug. 1, 1979, now U.S. Pat. No. 4,258,445.

TECHNICAL FIELD

An improved adjustable body supporting assembly distinguished by a more elevating and forward moving upper portion of a transversely divided adjustable back support, when said back support is elevated, in order to provide a more supported and curved positioning for the spine and back of an occupant.

BACKGROUND ART

Adjustable body supporting assemblies, such as positioning beds, adjustable hospital-type beds and adjustable chairs having been well known serving for various positioning of an occupant, but the art was singularly lacking adjustable beds and especially hospital beds providing proper supported and curved positioning for the back, shoulder and head and positioning of an occupant more comfortably for such activities such as eating, reading and TV viewing. Until now, adjustable beds and hospital beds were all provided upward at a slant, when adjustably elevated, and usually not providing a desired "sit-up" position, unless other items, such as "propping-up pillows" are added to raise the upper body portion of an occupant.

OBJECT OF THE INVENTION

To provide body supporting assemblies with a transversely divided back support whose upper and head supporting portion is pivotally connected to the lower portion and which when the back support is elevated by a single power means moves progressively upward and forward at an angle to and in relation to the lower portion. To build adjustable beds and specifically hospital-type beds with adjustable transversely divided back supports in order to provide a better contured support for the curved human spine and also a better sitting up position. To build such assemblies and mount them piovtally on a base to provide for an adjustable slant.

DISCLOSURE OF THE INVENTION

An improved adjustable body supporting assembly is discussed, which is distinguished by its capability to provide with a single power means the movement of a support and the additional movement of a second support in relation to the said first support, and especially of a transversely divided back support. To provide more comfort and more supported position to the curved spine and back of an occupant, the back support of this invention is divided in an upper and a lower portion. The lower portion is pivoting from the middle or butt supporting portion of the assembly and is provided with the means for adjustable elevation. The upper portion of said back support is pivoting from this lower back support portion and is progressively moved upward and forward in relation to said lower portion, when said back support is elevated by means such as a linkage. In one type of linkage, downward extending members of said upper portion are connected to the frame and cause the upper support portion to move progressively upward when the lower back support portion is elevating.

BODY SUPPORT ASSEMBLY WITH PROGRESSIVELY FORWARD ADJUSTING HEADREST

Figure 1:
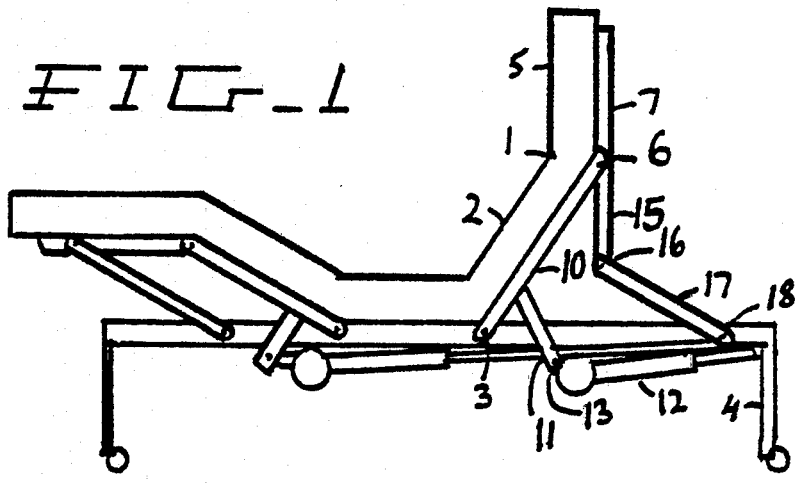
FIG. 1 is a side view of the embodiment wherein the movement of the upper portion of the back support is accomplished by means of a linkage to the frame.

An improved ajustable body support assembly is shown in FIG. 1. The back support 1 is divided transversely into a lower portion 2 pivoted at 3 to the base frame 4, and into an upper portion 5 pivoted to said lower portion at 6. Upper portion 5 comprises a support 7 and a lower portion comprises a support 10, said supports 7 and 10 being pivotally connected to each other at 6. Support 7 has a lower portion 15 that is pivotally connected at 16 to link 17, which in turn is pivotally connected to base frame 4 at 18. Support 10 is provided with a downward extension 11 into which one end of a single power means, such as a screwdrive 12, is secured at 13. The other end of the power means is secured to base frame 4.

EMBODIMENT OF FLUID POWERED TRANSVERSELY DIVIDED BACKSUPPORT

Figure 2:
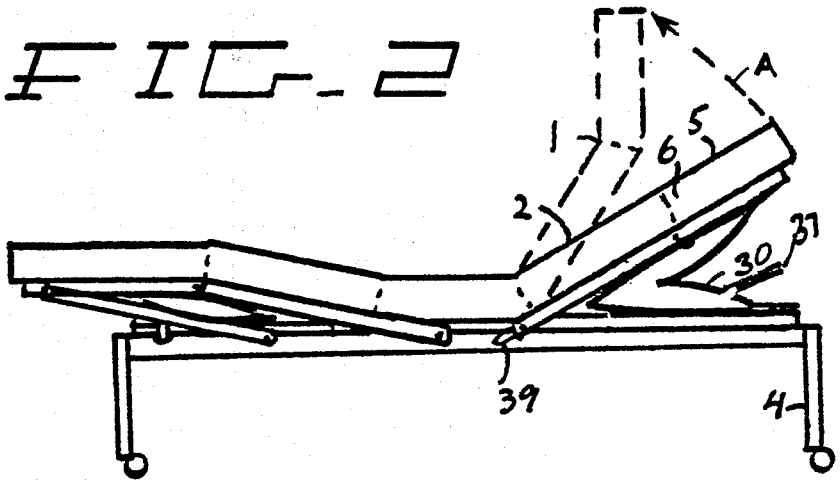
FIG. 2 is a side view of the embodiment wherein the single power means is a fluid fillable bladder.

A modified embodiment, which utilizes fluid under pressure to elevate the divided back support, is shown in FIG. 2. An elongated bladder 30 is positioned on a panel 33, which rests on base frame 4. If fluid under pressure is inserted through the inlet 37 into the bladder, the upper portion 5 will start to elevate first, and continued inflation will cause the whole back support to elevate until the lower portion is restrained from further movement by restraining means 39. Restraining means 39 is an extension on the lower portion 2 that, at a predetermined inclination of lower support 2, will abut against a portion of base frame 4, thus permitting only pivoted upper portion 5 to elevate upon further inflation of bladder 30. Arrow "A" shows the upward movement of the back surface to elevated position shown in phantom lines.

I claim:

1. An adjustable body supporting assembly comprising a horizontal frame member (4), a back support portion (1) pivotably connected to said frame member, and divided into a lower back support (2) and an upper head support (5) pivotable connected to said lower back support, and a single power means adapted to raise the lower back support and upper head support, from a horizontal position to angular positions in which the lower back support is inclined relative to the frame, and the upper head support is inclined relative to the frame and the lower back support.

2. The body supporting assembly of claim 1, further comprising link means (17) connecting the frame to an extension (15) extending from the upper head support, and extension means (11) connecting the power means to the lower back support.

3. The body supporting assembly of claim 1 wherein the power means is a bladder (30) adapted to be filled with a fluid, said bladder being located on top of the frame (4) and below said lower back support and upper head support.

* * * * *

UNITED STATES PATENT OFFICE

CERTIFICATE OF CORRECTION

Patent No. 4,349,924 Dated September 21, 1982

Inventor(s) Henry C. Zur

It is certified that error appears in the above-identified patent and that said Letters Patent are hereby corrected as shown below:

Column 2, line 43:

"surface" should be --support--

Signed and Sealed this

Eighth Day of January 1985

[SEAL]

*Attest:*

*Attesting Officer*

GERALD J. MOSSINGHOFF

*Commissioner of Patents and Trademarks*